US009306300B2

(12) United States Patent
Chung et al.

(10) Patent No.: US 9,306,300 B2
(45) Date of Patent: Apr. 5, 2016

(54) OBVERSELY AND REVERSELY PLUGGABLE CONNECTOR STRUCTURE

(71) Applicant: KUANG YING COMPUTER EQUIPMENT CO., LTD., New Taipei (TW)

(72) Inventors: Hsuan-Ho Chung, New Taipei (TW); Yu-Hung Lin, New Taipei (TW); Wei-Pang Chung, New Taipei (TW); Kuang-Shan Li, New Taipei (TW); Yuan-Chin Chiang, New Taipei (TW)

(73) Assignee: KUANG YING COMPUTER EQUIPMENT CO., LTD., New Taipei (TW)

( * ) Notice: Subject to any disclaimer, the term of this patent is extended or adjusted under 35 U.S.C. 154(b) by 16 days.

(21) Appl. No.: 14/324,240

(22) Filed: Jul. 7, 2014

(65) Prior Publication Data

US 2016/0006148 A1 Jan. 7, 2016

(51) Int. Cl.
*H01R 24/00* (2011.01)
*H01R 12/51* (2011.01)
*H01R 13/6581* (2011.01)

(52) U.S. Cl.
CPC ..... *H01R 12/51* (2013.01); *H01R 13/6581* (2013.01)

(58) Field of Classification Search
CPC .. H01R 23/7073; H01R 23/02; H01R 23/725; H01R 13/26; H01R 13/658
USPC ..... 439/660, 607.36, 607.4, 79
See application file for complete search history.

(56) References Cited

U.S. PATENT DOCUMENTS

2011/0217878 A1* 9/2011 Liu ..... H01R 24/00 439/630
2012/0252278 A1* 10/2012 Chang ..... H01R 12/724 439/660
2014/0242849 A1* 8/2014 Yamaguchi ..... H01R 29/00 439/660

* cited by examiner

*Primary Examiner* — Phuong Dinh
(74) *Attorney, Agent, or Firm* — Leong C. Lei

(57) ABSTRACT

An obversely and reversely pluggable connector structure, includes a multi-plate circuit board, first transmission conductor set and second transmission conductor set each, a plurality of first soldering faces and second soldering faces, a plurality of first conduction portions and second conduction portions, a plurality of first through holes and second through hole portions, a first shielding shell and second shielding shell each, first capacitor unit and second capacitor unit each at least, allowing the first transmission conductor set and second transmission conductor set different in length to clamp a connector to the circuit board together through the above components, and components for soldering, conducting, reducing noise are configured correspondingly to each transmission conductor set, thereby achieving the reduction of the volume upon a connector assembly, and having the effect of decreasing EMI (Electromagnetic interference) and RFI (radio frequency interference).

4 Claims, 13 Drawing Sheets

OBVERSELY AND REVERSELY PLUGGABLE CONNECTOR STRUCTURE

TECHNICAL FIELD OF THE INVENTION

The present invention relates to an obversely and reversely pluggable connector structure, and more particularly to an obversely and reversely pluggable connector structure, capable of clamping and fixing a connector from the upper side and lower side of a circuit board, reducing the volume after the assembly is completed, and having a noise restraining function.

DESCRIPTION OF THE PRIOR ART

The use of connectors is fully universal with respect to the current technologies. No matter what kind of connector, for example, universal serial bus (USB), micro-USB or mini-USB, it is, to avoid reverse plugging, the opposite joint direction of male and female contacts must always be affirmed before plugging, or the deformation of male and female contacts or the damage of substrates is caused easily due to the reverse plugging.

Although non-directional connectors are available in the market, they are not accepted by people or manufacturers, the reasons are approximately the followings:

1. the soldering of a connector and PCB (printed circuit board) can only be carried out by means of a process such as double-face DIP or one-face DIP, one-face SMT, giving quite a labor power burden to manufacturers.
2. to achieve double-directional plugging, the thickness of a connector must be increased, and therefore to increase the volume, but it is a taboo to 3C industries.
3. signal interference between terminals is very serious upon double-directional plugging.

SUMMARY OF THE INVENTION

The main object of the present invention is to provide an obversely and reversely pluggable connector structure, using first and second transmission conductor sets different in length respectively configured on the upper and lower sides of a circuit board together to clamping and fixing a connector thereto, configuring components such as soldering faces, through holes, a shielding shell, a capacitor unit and conduction portions correspondingly on each transmission conductor set so as to complete the obversely and reversely pluggable connector, having the advantages of easy assembly, small volume and low interference.

To achieve the above object, the present invention mainly includes a first transmission conductor set configured on one side of the circuit board, a plurality of first soldering faces defined on the circuit board correspondingly to the first transmission conductor set, a plurality of first conduction portions configured on circuit board far away from inner layers of the first soldering faces, a plurality of through holes respectively configured on one side of the circuit board far away from each first soldering face, a first shielding shell adapted to accommodate the first transmission conductor set, and at least one first capacitor unit configured on the circuit board and accepted inside the first shielding shell. Furthermore, a different length of second transmission conductor is configured on another side of the circuit board far away from the first transmission conductor set, including the second soldering faces, second through holes, a second shielding shell, a second capacitor unit and second conduction portions correspondingly to the first transmission conductor set, thereby using the first transmission conductor set and second transmission conductor set to clamp the circuit directly upon assembly, reducing the entire volume after assembly, and decreasing interference upon use.

The complicated process, larger volume and serious interference existing in conventional double-directionally pluggable connector can be broken through by means of the above technologies, achieving the above advantages.

DETAILED DESCRIPTION OF THE PREFERRED EMBODIMENTS

Figure 1:
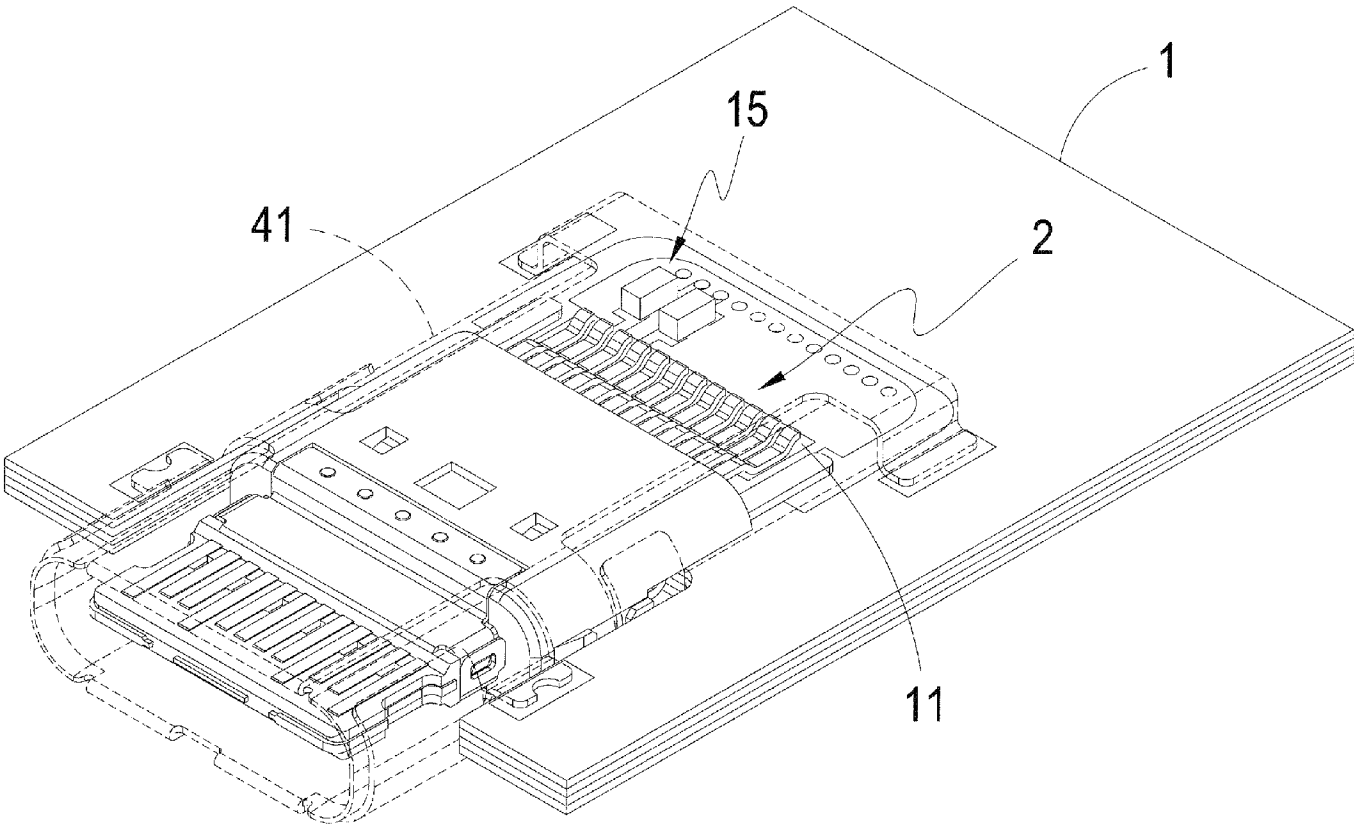
FIGS. 1 and 2 are perspective views of an obversely and reversely pluggable connector structure of a preferred embodiment according to the present invention.
Figure 2:
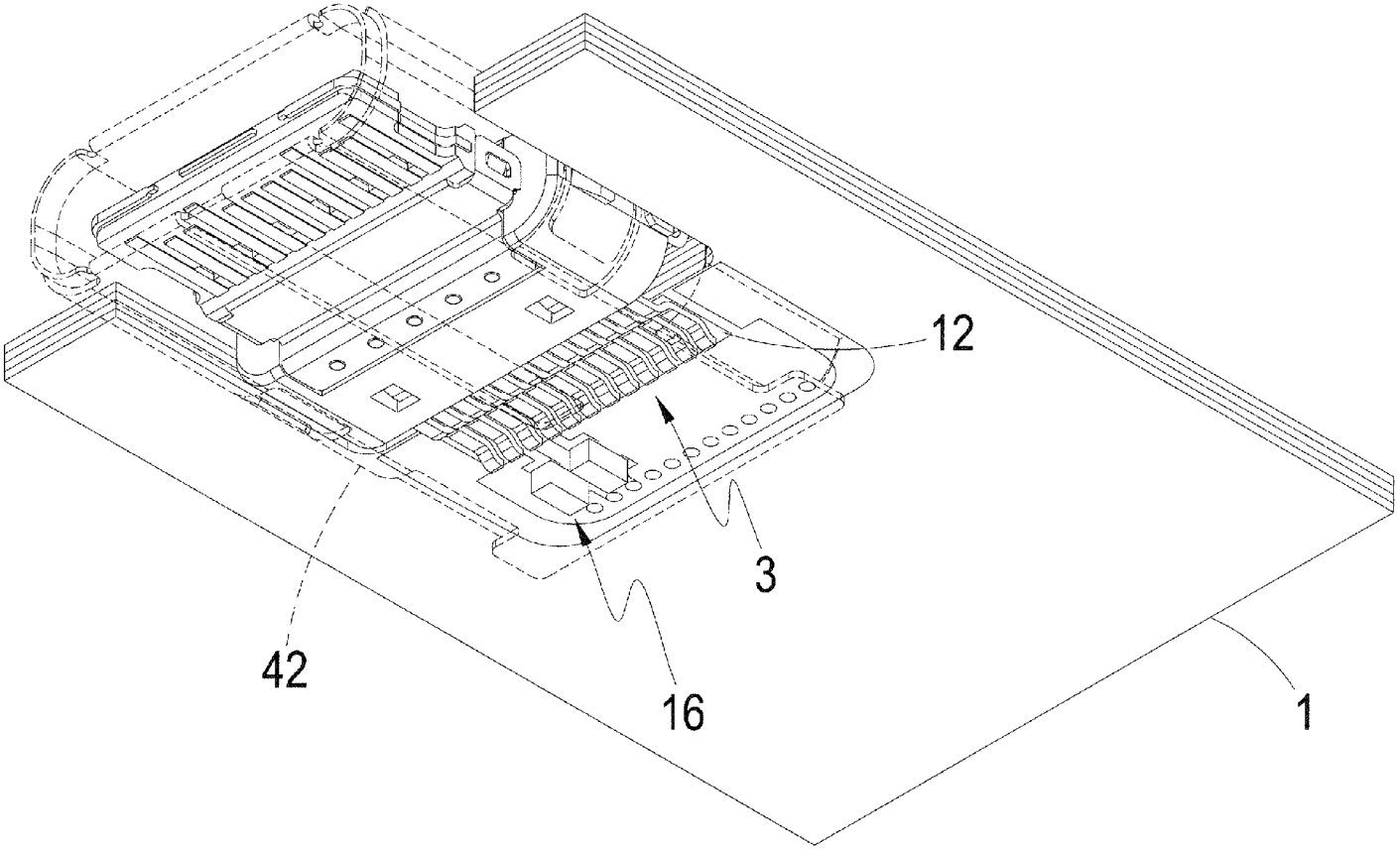
Figure 3:
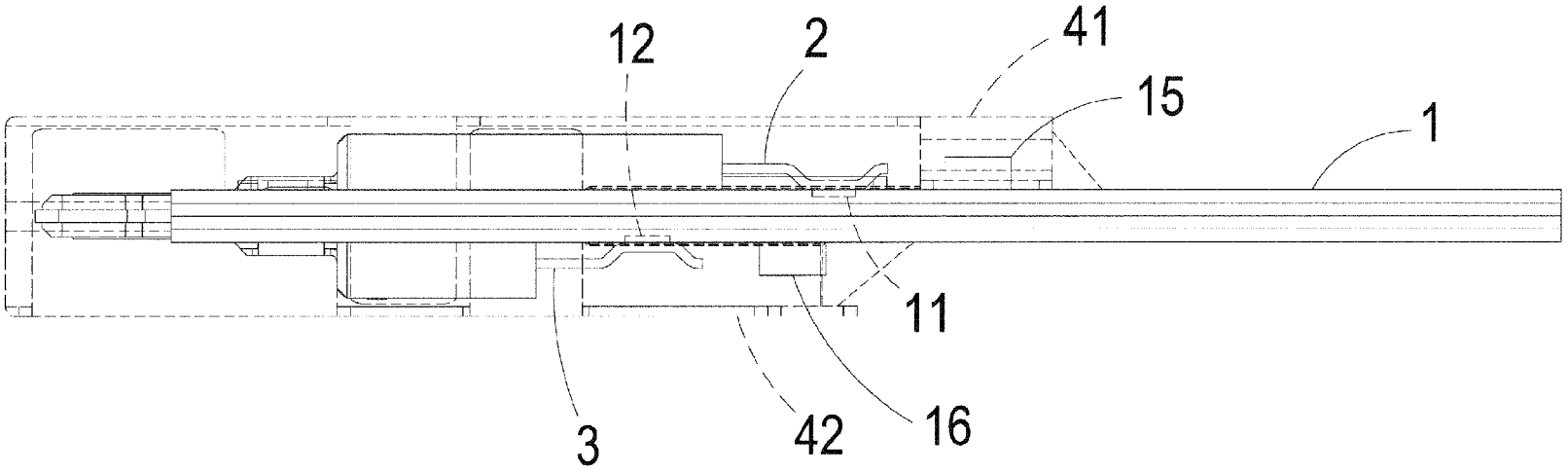
FIG. 3 is a side view of the connector structure of the embodiment according to the present invention.
Figure 4:
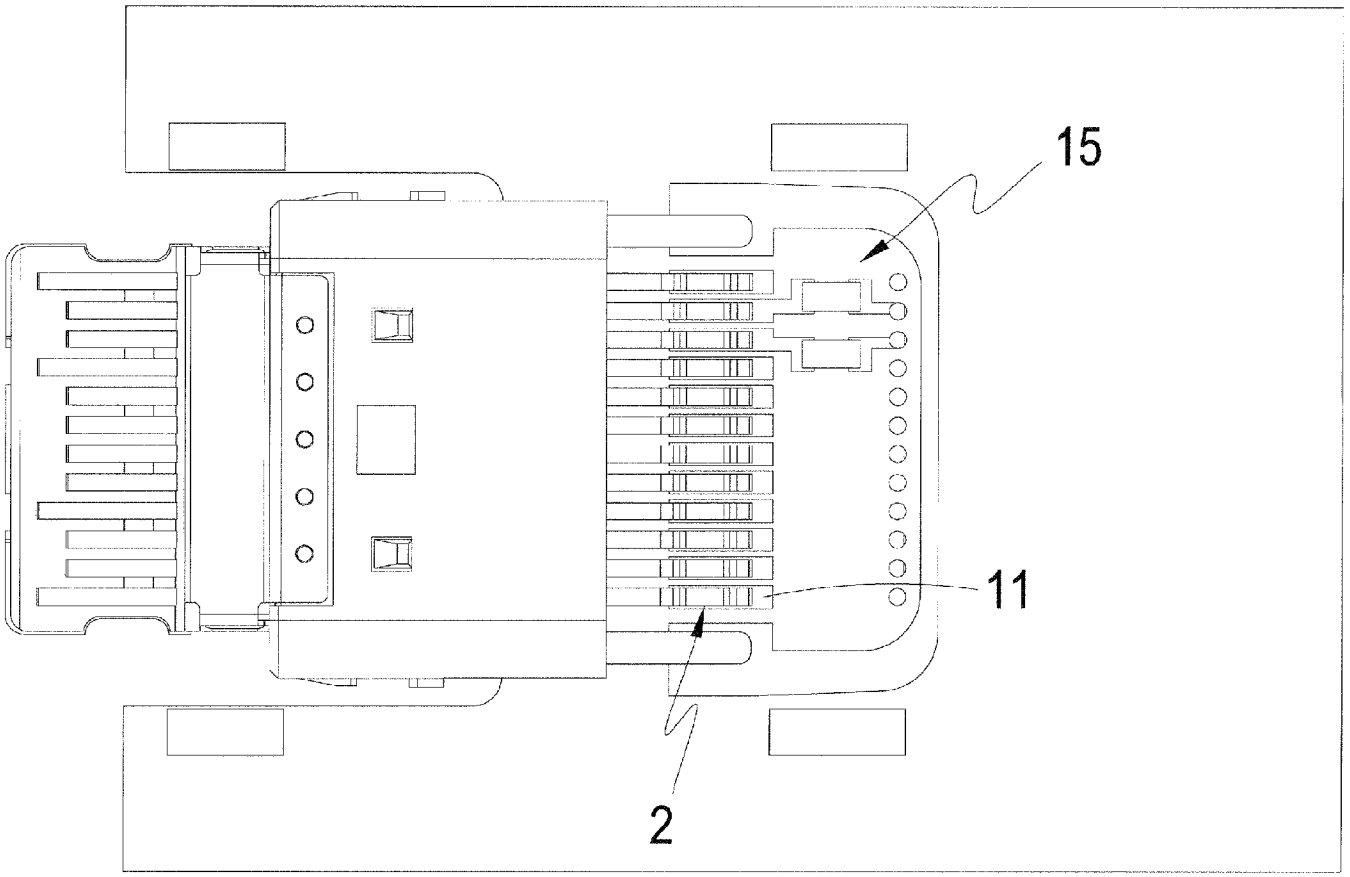
FIG. 4 is a top view of the embodiment according to the present invention.
Figure 5:
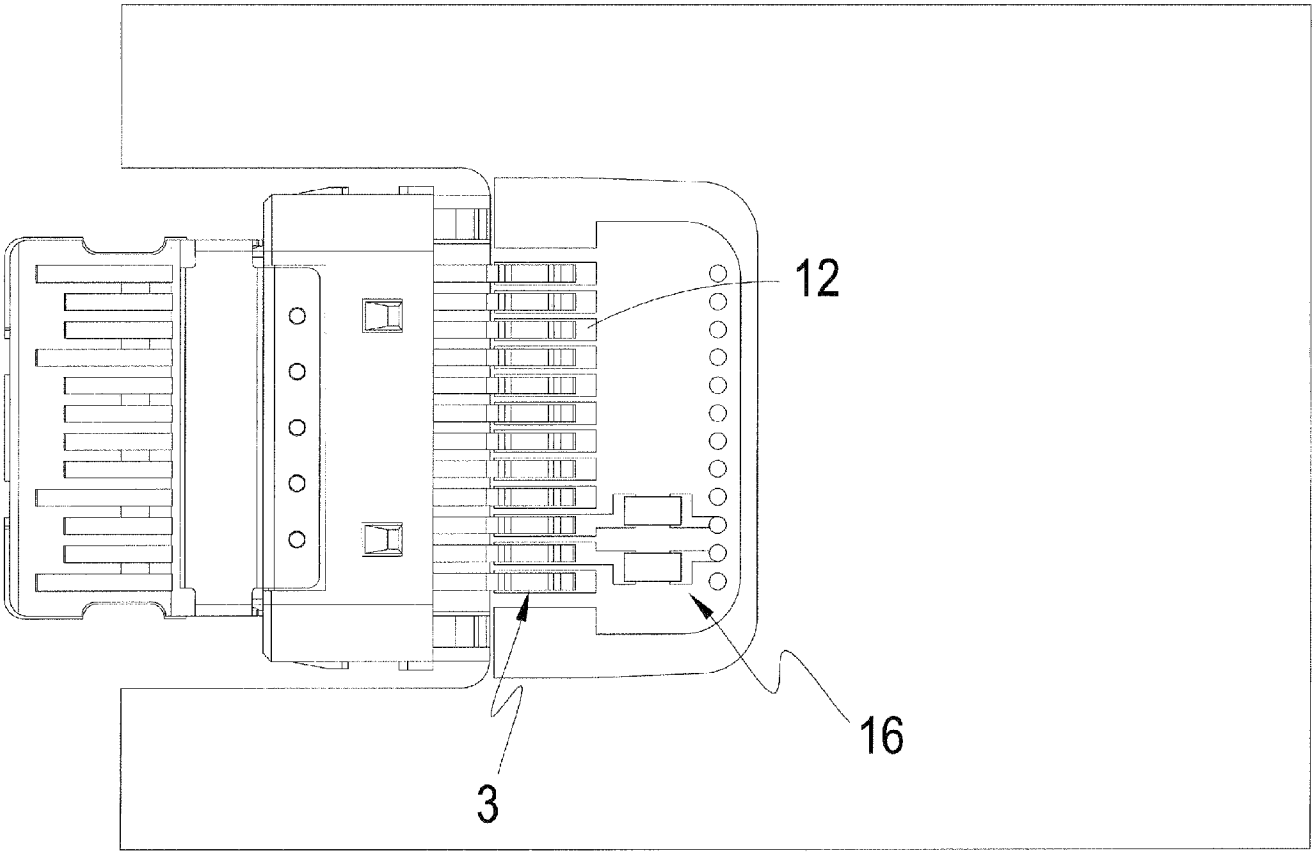
FIG. 5 is a bottom view of the embodiment according to the present invention.

Referring to FIGS. 1 to 5, a obversely and reversely pluggable connector structure of the present invention includes:

a circuit board 1;

a first transmission conductor set 2, configured on one side of the circuit board 1;

a plurality of soldering faces 11, defined on the circuit board 1 correspondingly to the first transmission conductor set 2;

a first shielding shell 41, adapted to accommodate the first transmission conductor set 2;

at least one first capacitor unit 15, configured on the circuit board 1 and accepted inside the first shielding shell 41, the first capacitor unit 15 being positioned on one side of the first soldering face 11;

a second transmission conductor set 3, configured on another side of the circuit board 1 far away from the first transmission conductor set 2, the second transmission conductor set 2 being smaller than the first transmission conductor set 2 in length, and the connector being clamped to the circuit board 1 through the first transmission conductor set 2 together with the second transmission conductor set 3;

a plurality of second soldering faces 12, defined on the circuit board 11, correspondingly to the second transmission conductor set 3;

a second shielding shell 42, adapted to accommodate the second transmission conductor set 3; and at least one second capacitor unit 16, configured on the circuit board 1 and accepted inside the second shielding shell 42, the second capacitor unit 16 being positioned on one side of the second soldering faces 12.

In the present embodiment, the longer first transmission conductor set 2 positioned on the upper side of the circuit board 1 is soldered on the first soldering faces 11 at the corresponding position with a soldering portion at one end thereof, and the shorter second transmission conductor set 3 positioned on the lower side of the circuit board 1 is soldered on the second soldering faces 12 at the corresponding position with a soldering portion at one end thereof, thereby clamping the connector to the circuit board 1 to form a clamp type connector. In addition, the first capacitor unit 15 is configured on the side of the first soldering faces 11, allowing the first shielding shell 41 to accommodate the first transmission conductor set 2 and the first capacitor unit 15 inside it at one time, and at the other side of the circuit board 1, the second capacitor unit 16 is configured on the side of second soldering face 12, allowing the second shielding shell 42 to accommodated the second transmission conductor set 3 and the second capacitor unit 16 inside it at one time, thereby enabling the connector of the present invention to be assembled by means of full SMT (surface mount technique) soldering process, capable of decreasing the interference derived from DIP (Dual In Line Package) process substantially. Furthermore, the connector of the present invention is isolated from the outside by the shielding shells, facilitating the restraint of EMI (Electromagnetic interference) or RFI (radio frequency interference) considerably.

Figure 6:
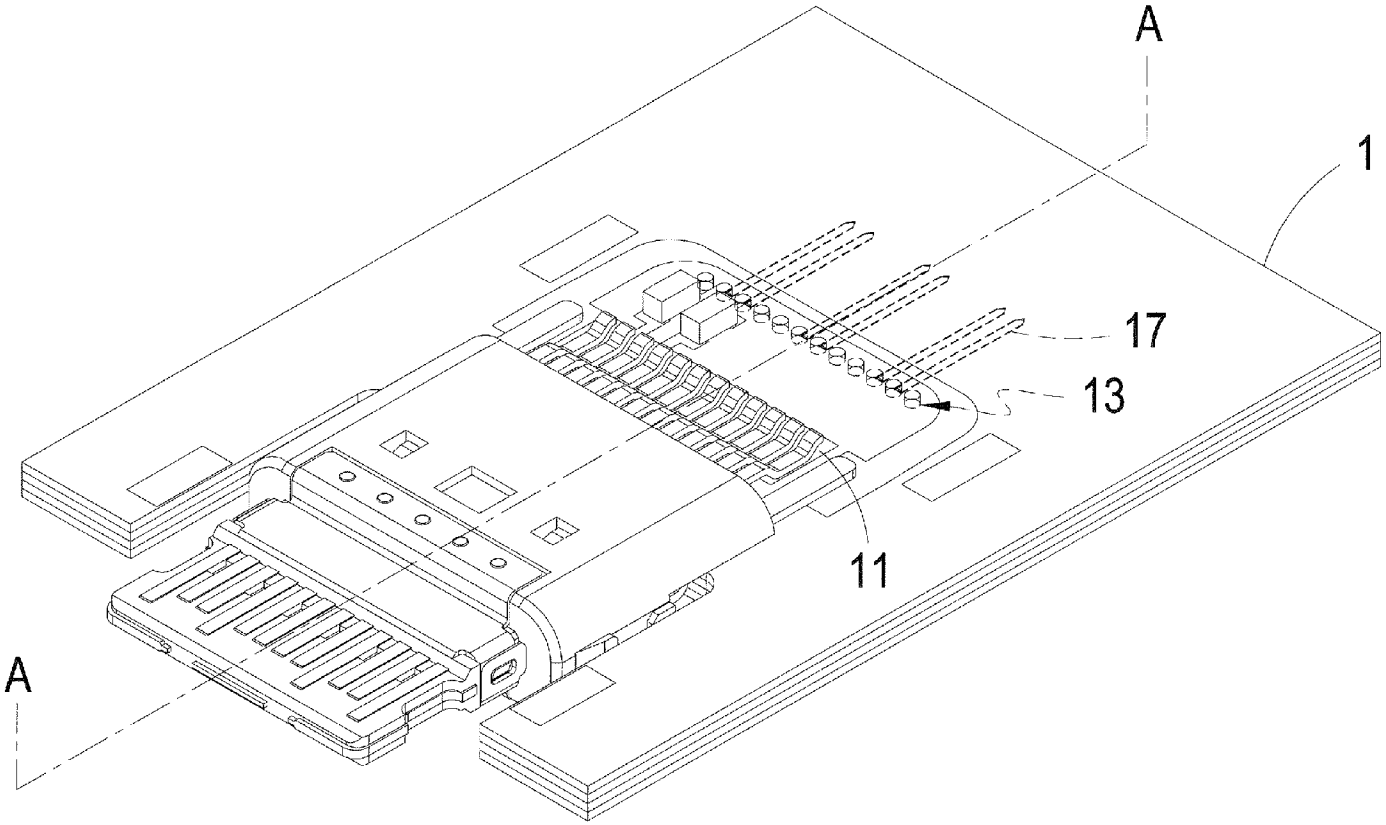
FIG. 6 is a perspective view of the embodiment according to the present invention.
Figure 7:
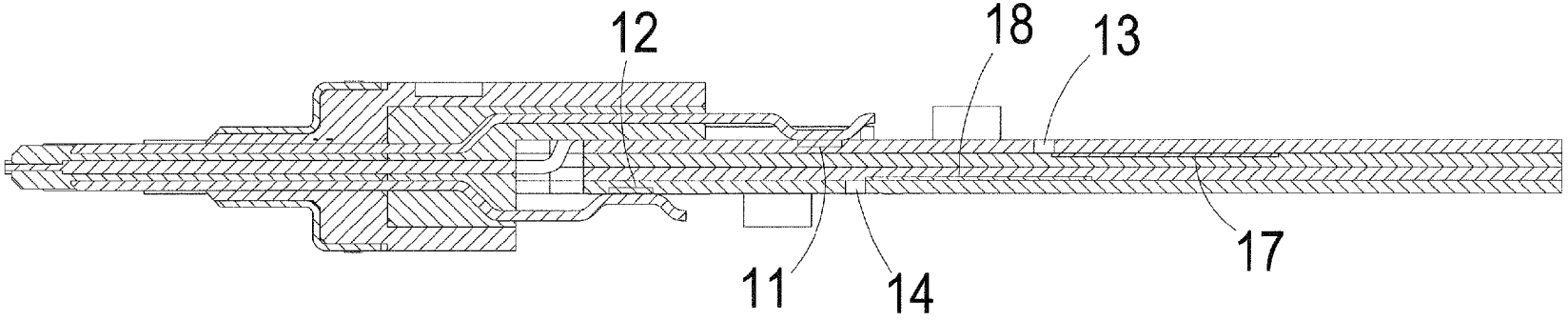
FIG. 7 is a cross-sectional view taken along line A-A of FIG. 6.

Referring to FIGS. 6 and 7, it can be clearly seen that the present invention, besides the structure of the above-mentioned embodiment, when the circuit board 1 is a multi-layer plate, further includes:

a plurality of first through hole portions 13, respectively configured on one side of the circuit board 1 far away from each first soldering face 11;

a plurality of second through hole portions 14 respectively configured on one side of the circuit board 1 far away from each second soldering face 12;

a plurality of first conduction portions 17, configured on the circuit board 1 and far away from the inner layers of the first soldering faces 11; and a plurality of second conduction portions 18, configured on the circuit board 1 and far away from the inner layers of the second soldering faces 12.

In the present embodiment, to strengthen the effect of restraint from noise interference once again, the first, second conduction portions 17, 18 adapted to conduct electrically the connector with circuit board 1 are respectively configured on a dielectric layer below the surface layer of the circuit board 1, and the first through hole portions 3 are in electric connection with the first soldering portions on the surface layer of the circuit board 1 and the second through hole portions 14 are in electric connection with the second soldering portions on the surface layer of the other side of the circuit board 1. In addition, because the first through portions 13 and the second through hole portions 14 are respectively configured correspondingly on the sides of to the first soldering faces 11 and second soldering faces 12, and the first soldering faces 11 and the second soldering faces 12 are then respectively configured correspondingly to the first transmission conductor set 2 and second transmission conductor set 3, the first through hole portions 13 and second through hole portions 14 are back and forth in an interlaced arrangement way to further strengthen the effect of the isolation from noisy.

Figure 8:
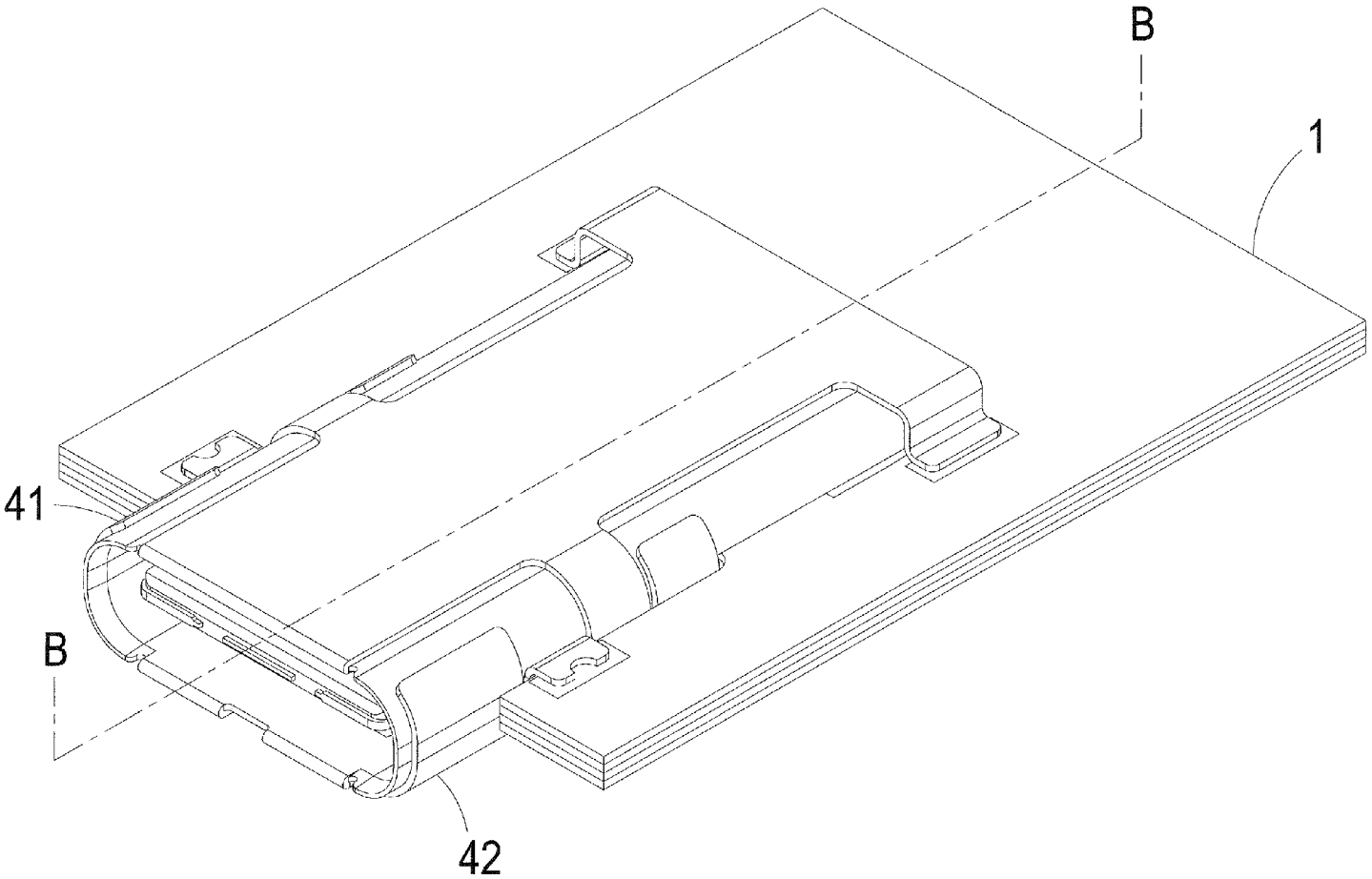
FIG. 8 is a perspective view of the embodiment according to the present invention.
Figure 9:
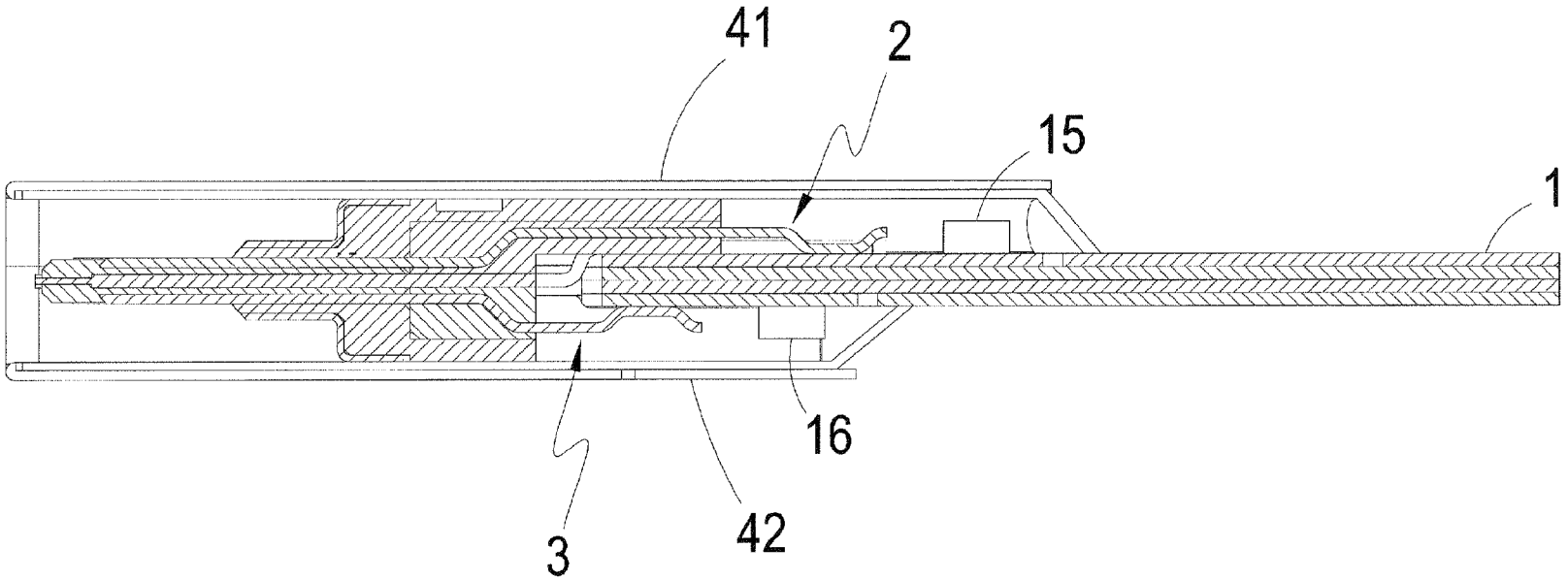
FIG. 9 is a cross-sectional view taken along line B-B of FIG. 8.

Referring to FIGS. 8 and 9, it can be seen clearly that in the present embodiment, all the components in the two above embodiments are combined together, and the first, second transmission conductor sets 2, 3 and the first, second capacitor units 15, 16 are accepted inside the first, second shielding shell 41, 42 correspondingly. In addition, the entire thickness of the clamp type connector added with the shielding shell deduct the thickness of the circuit board 1 itself therefrom comparing with general connectors fixed directly on the surface of the circuit board 1, and the thickness of a general circuit board is ranged between 0.5 mm and 2 mm and the thickness of a general connector is ranged between 1 cm and 2 cm. In another word, the thickness of the connector of the present invention is reduced by 2.5%~20%, it is promising progressive in relation to conventional connectors.

Figure 10:
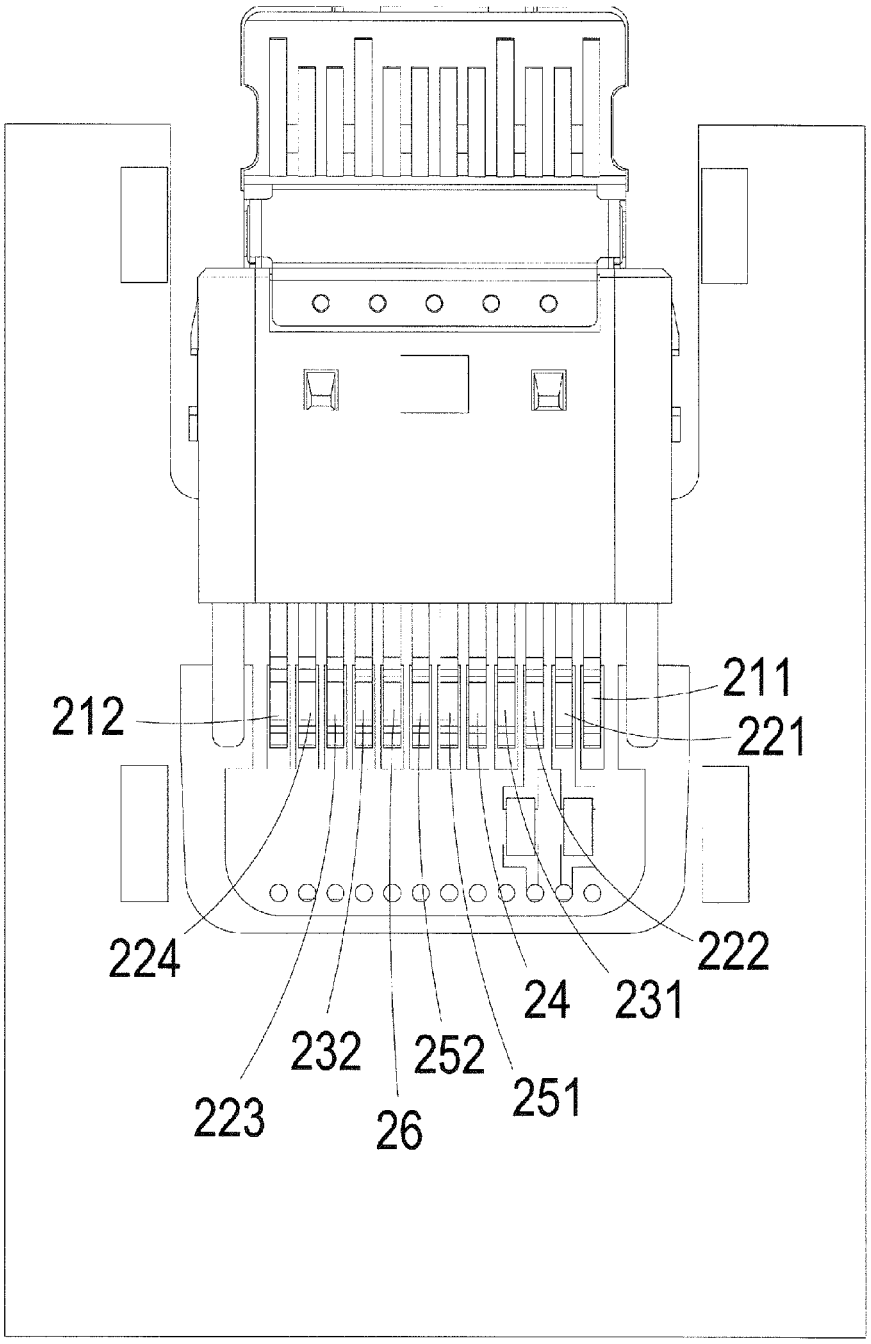
FIG. 10 is a top view of transmission conductors of the embodiment according to the present invention.
Figure 11:
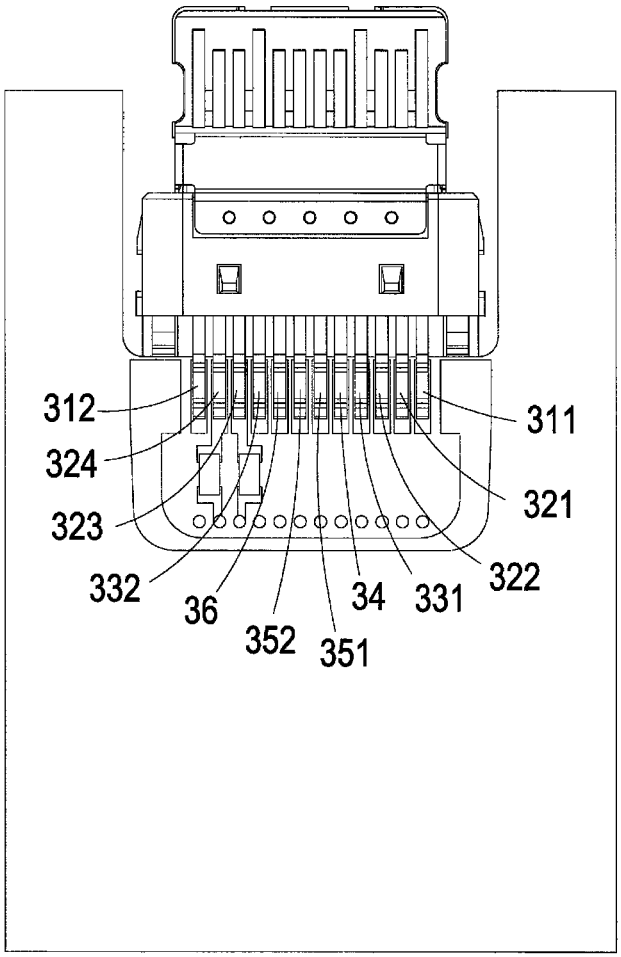
FIG. 11 is a bottom view of the transmission conductors of the embodiment according to the present invention.

Referring to FIGS. 10 and 11, it can be seen clearly that the first transmission conductor set includes a grounding transmission conductor 211, first differential signal transmission conductor 221, second differential signal transmission conductor 222, first power transmission conductor 231, first assignment channel transmission conductor 24, first signal transmission conductor 251, second signal transmission conductor 252, backup transmission conductor 26, second power transmission conductor 232, third differential signal transmission conductor 223, fourth differential signal transmission conductor 224 and second grounding transmission conductor 212 configured side by side in sequence; and the second transmission conductor set then includes a third grounding transmission conductor 311, fifth differential signal transmission conductor 321, sixth differential signal transmission conductor 322, third power transmission conductor 331, second assignment channel transmission conductor 34, third signal transmission conductor 351, fourth signal transmission conductor 352, second backup transmission conductor 36, fourth power transmission conductor 332, seventh differential signal transmission conductor 323, eighth differential signal transmission conductor 324 and fourth grounding transmission conductor 312 configured side by side in sequence.

The above is a full-featured plug pin assignment, conforming to USB Type-C interface standard and being a double-face staggered arrangement, thereby allowing the connector of the present invention to be plugged in obversely and reversely without the issue of directionality or polarity.

Figure 12:
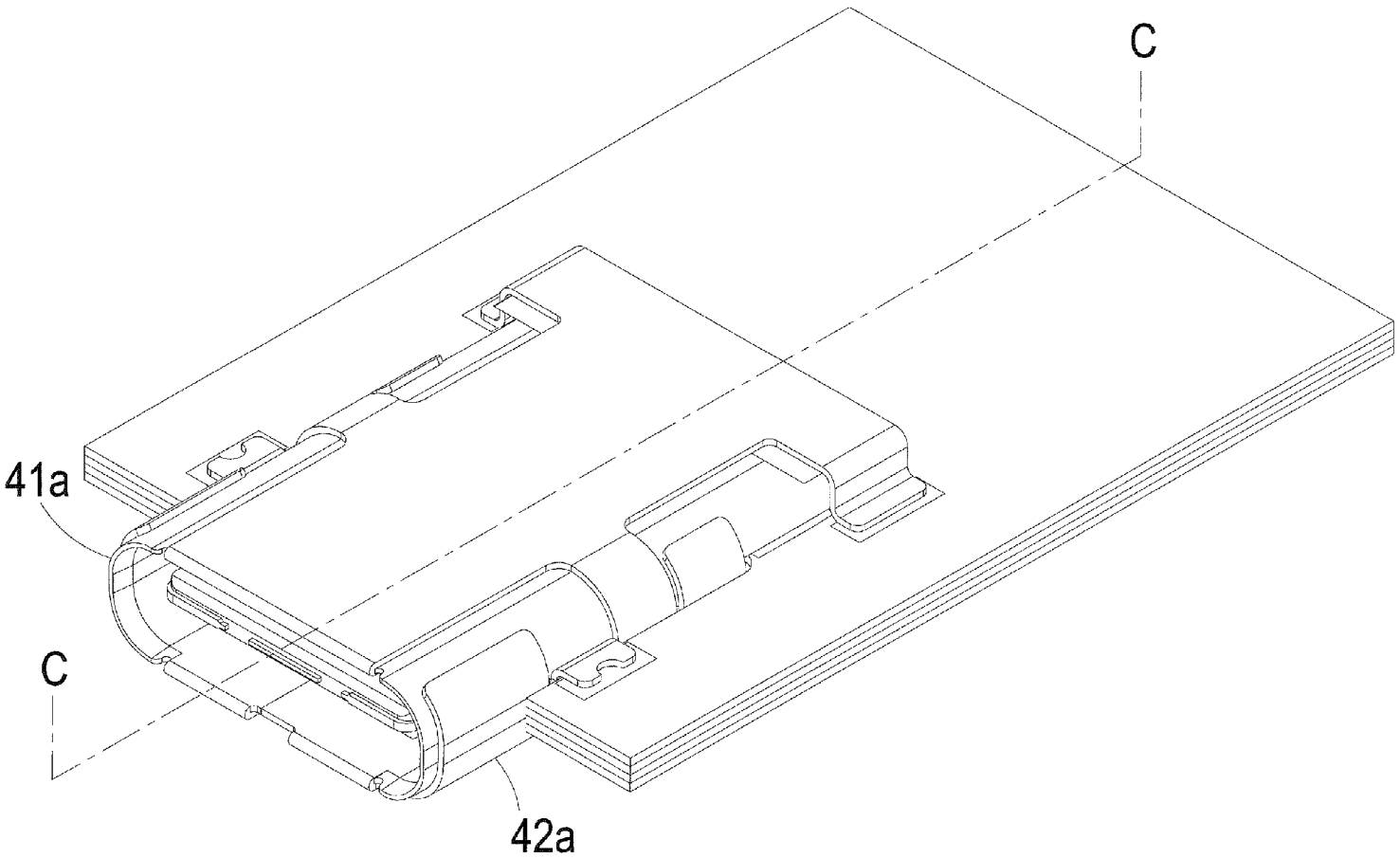
FIG. 12 is a perspective view of another preferred embodiment according to the present invention.
Figure 13:
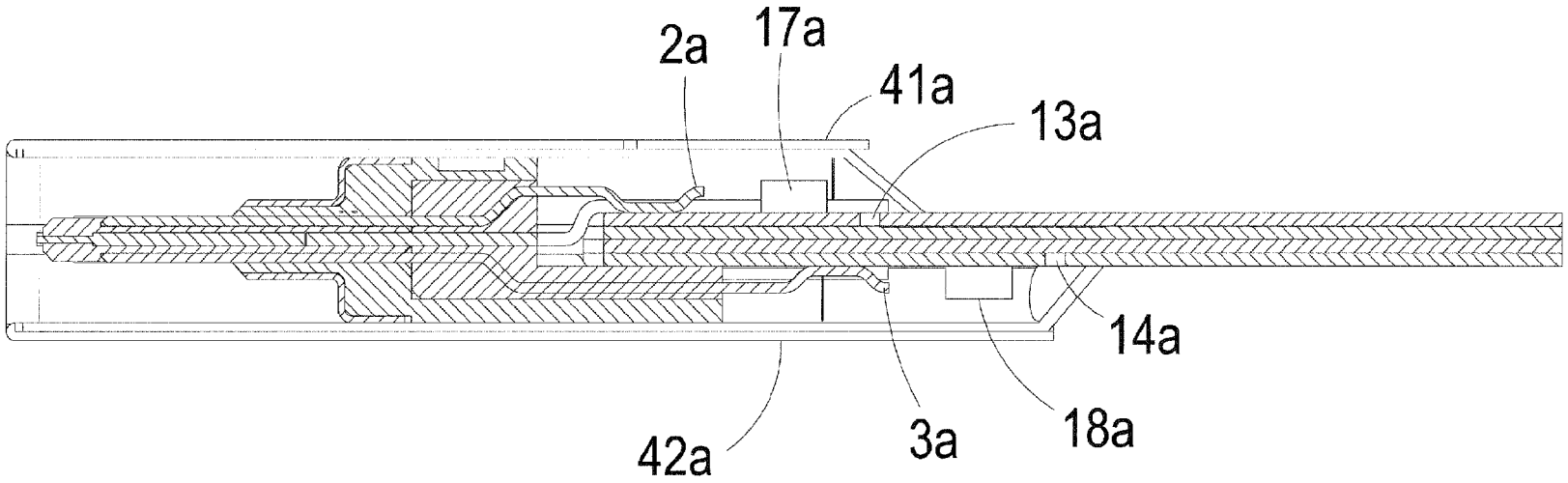
FIG. 13 is a cross-sectional view taken along line C-C of FIG. 12.

Furthermore, referring to FIGS. 12 and 13, in can be seen clearly from the figures that the present embodiment is similar to the above embodiment in structure, except the length of a second transmission conductor set 3*a* is larger then the one of the first transmission conductor 2*a*, opposite to the length relationship between the first transmission conductor set 2 and second transmission conductor 3 mentioned above which the length of the first transmission conductor set 2 is larger than the one of the second transmission conductor set 3. As a result, the positions of the other corresponding elements including first, second shielding shells 41*a*, 42*b*, first, second capacitor units 17*a*, 18*a* and first, second through portions 13*a*, 14*a* are adjusted and changed accordingly, but the functions and features achieved are not affected; the connector of the present embodiment still has the advantages such as easy assembly, small volume and low interference.

Therefore, the technical key points of the obversely and reversely pluggable connector structure according to the present invention are in that:

1. the design of the transmission conductor sets allows the assembly process to be carried out not by means of DIP, reducing manual burden and signal interference derived from DIP process.

2. the entire thickness of the clamp type connector can deduct the circuit board 1 from it such that the volume thereof is smaller than conventional connectors.
3. high EMI or RFI generated from conventional obverse and reverse plug can be controlled here by cooperating with the isolation effect of the hidden type circuits, through holes and shielding shells.

I claim:

1. An obversely and reversely pluggable connector structure, comprising:

a circuit board;

a first transmission conductor set, configured on one side of said circuit board;

a second transmission conductor set, configured on another side of said circuit board far away from said first transmission conductor set, and said second transmission conductor set being longer or shorter than said first transmission conductor set, and a connector being clamped to said circuit board through said first transmission conductor set and second transmission conductor set together; and a first shielding shell adapted to accommodate said first transmission conductor set and a second shielding shell adapted to accommodate said second transmission conductor set;

wherein a plurality of first soldering faces are defined on said circuit board correspondingly to said first transmission conductor set, and a plurality of second soldering faces are defined on said circuit board correspondingly to said second transmission conductor set, a first through hole portion configured on one side of said circuit board far away from said each first soldering face, and a second through hole is configured on one side of said circuit board far away from said each second soldering face, and at least one first capacitor unit accepted inside said shielding shell is configured on said circuit board, and at least one second capacitor unit accepted inside said second shielding shell is configured on said circuit board.

2. The structure according to claim 1, wherein a plurality of first conduction portions are configured on positions of said circuit board far away from an inner layer of said each first soldering face, and a plurality of second conduction portions are configured on positions of said circuit board far away from an inner layer of said each second soldering face.

3. The structure according to claim 2, wherein said first transmission comprises: a first grounding transmission conductor; a first differential signal transmission conductor, configured on one side of said first grounding transmission conductor; a second differential signal transmission conductor, configured on one side of said first differential signal transmission conductor far away from said first grounding transmission conductor; a first power transmission conductor, configured on one side of said second differential signal transmission conductor far away from said first differential signal transmission conductor; a first assignment channel transmission conductor, configured on one side of said first power transmission conductor far away from said second differential signal transmission conductor; a first signal transmission conductor, configured on one side of said first assignment channel transmission conductor far away from said first power transmission conductor; a second signal transmission conductor, configured on one side of said first signal transmission conductor far away from said first assignment channel transmission conductor; a first backup transmission conductor, configured on one side of said second signal transmission conductor far away from said first signal transmission conductor, a second power transmission conductor, configured on one side of said first backup transmission conductor far away from said second signal transmission conductor; a third differential signal transmission conductor, configured on one side of said second power transmission conductor far away from said first backup transmission conductor, a fourth differential signal transmission conductor, configured on one side of said third differential signal transmission conductor far away from said second power transmission conductor; and a second grounding transmission conductor, configured on one side of said fourth differential signal transmission conductor far away from said third differential signal transmission conductor, and said second transmission conductor set comprises: a third grounding transmission conductor; a fifth differential signal transmission conductor, configured on one side of said third grounding transmission conductor; a sixth differential signal transmission conductor, configured on one side of said fifth differential signal transmission conductor far away from said third grounding transmission conductor; a third power transmission conductor, configured on one side of said sixth differential signal transmission conductor far away from said fifth differential signal transmission conductor; a second assignment channel transmission conductor, configured on one side of said third power transmission conductor far away from said sixth differential signal transmission conductor; a third signal transmission conductor, configured on one side of said second assignment channel transmission conductor far away from said third power transmission conductor; a fourth signal transmission conductor, configured on one side of said third signal transmission conductor far away from said second assignment channel transmission conductor; a second backup transmission conductor, configured on one side of said fourth signal transmission conductor far away from said third signal transmission conductor, a fourth power transmission conductor, configured on one side of said second backup transmission conductor far away from said fourth signal transmission conductor; a seven differential signal transmission conductor, configured on one side of said fourth power transmission conductor far away from said second backup transmission conductor, an eighth differential signal transmission conductor, configured on one side of said seventh differential signal transmission conductor far away from said fourth power transmission conductor; and a fourth grounding transmission conductor, configured on one side of said eighth differential signal transmission conductor far away from said seventh differential signal transmission conductor.

4. The structure according to claim 3, wherein said first capacitor unit is configured on one side of said first soldering faces, and said second capacitor unit is configured on one side of said second soldering faces.

* * * * *